US011339458B2

(12) United States Patent
Strohl et al.

(10) Patent No.: US 11,339,458 B2
(45) Date of Patent: May 24, 2022

(54) NICKEL-BASE ALLOY FOR GAS TURBINE COMPONENTS

(71) Applicant: Chromalloy Gas Turbine LLC, Palm Beach Gardens, FL (US)

(72) Inventors: James Page Strohl, Stuart, FL (US); Gerhard E. Fuchs, Gainesville, FL (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 355 days.

(21) Appl. No.: 16/242,175

(22) Filed: Jan. 8, 2019

(65) Prior Publication Data

US 2020/0216932 A1 Jul. 9, 2020

(51) Int. Cl.

| | |
|---|---|
| ***C22C 19/05*** | (2006.01) |
| ***C22F 1/00*** | (2006.01) |
| ***C22F 1/10*** | (2006.01) |

(52) U.S. Cl.

CPC ..... *C22C 19/056* (2013.01); *C22F 1/002* (2013.01); *C22F 1/10* (2013.01)

(58) Field of Classification Search

None

See application file for complete search history.

(56) References Cited

U.S. PATENT DOCUMENTS

| | | | | |
|---|---|---|---|---|
| 6,416,596 | B1 * | 7/2002 | Wood | C22C 19/056 148/428 |
| 6,428,637 | B1 | 8/2002 | Wood et al. | |
| 6,818,077 | B2 | 11/2004 | Yoshinari et al. | |
| 6,908,518 | B2 | 6/2005 | Bouse et al. | |
| 9,034,248 | B2 | 5/2015 | Wang et al. | |
| 9,322,089 | B2 | 4/2016 | Biondo et al. | |
| 9,353,427 | B2 | 5/2016 | Wang et al. | |
| 2003/0103862 | A1 * | 6/2003 | Bouse | C22C 19/056 420/448 |
| 2010/0080729 | A1 * | 4/2010 | Biondo | C22C 19/03 420/448 |
| 2017/0100804 | A1 * | 4/2017 | Goncharov | B23P 15/02 |
| 2018/0305792 | A1 * | 10/2018 | Forsik | C22C 19/056 |

OTHER PUBLICATIONS

Sinha et al. Effect of residual elements on high performance nickel base superalloys for gas turbines and strategies for manufacture. Bull Mater. Sci., vol. 28, No. 4, Jul. 2005, pp. 379-382. (Year: 2005).*

* cited by examiner

*Primary Examiner* — Brian D Walck
(74) *Attorney, Agent, or Firm* — Avek IP, LLC

(57) ABSTRACT

A nickel-based alloy is disclosed which is suitable for casting gas turbine components having improved strength and comparative lower density while utilizing commercially available heat treatment cycles. The nickel-based alloy is suitable for providing equiaxed, directionally solidified, and single crystal castings. Methods of providing a cast article of the nickel-based alloy and subjecting the article to heat treatment cycles are also disclosed.

20 Claims, No Drawings

NICKEL-BASE ALLOY FOR GAS TURBINE COMPONENTS

FIELD OF THE INVENTION

This invention is related to gas turbines. More specifically, the invention is directed to nickel-based alloys for use in casting gas turbine parts.

BACKGROUND

The materials that make up components of gas turbine engines have an acute effect on the performance of the engine. Over time, advancements in materials used in the manufacture of gas turbine engine components have resulted in gas turbine engines with higher power ratings and efficiency levels. Various high performance materials such as steel, alloys, and superalloys are used in the manufacture of components based on the properties of the material and the requirements of the component being manufactured. Even while significant improvements in alloys have been achieved in recent years, there is still a need for alloys having higher strength ratings, and for methods of casting those alloys.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a nickel-based alloy for a gas turbine component comprises about 3.0-4.0 wt. % aluminum (Al), about 0.005-0.015 wt. % boron (B), about 0.0-0.0001 wt. % bismuth (Bi), about 0.03-0.08 wt. % carbon (C), about 10.0-15.0 wt. % chromium (Cr), about 10.0-15.0 wt. % cobalt (Co), about 0.0-0.2 wt. % iron (Fe), about 0.0-0.1 wt. % hafnium (Hf), about 0.0-0.001 wt. % lead (Pb), about 0.0-0.02 wt. % magnesium (Mg), about 0.0-0.2 wt. % manganese (Mn), about 1.0-3.0 wt. % molybdenum (Mo), about 0.0-0.002 wt. % nitrogen (N), about 0.0-0.2 wt. % niobium (Nb), about 0.0-0.002 wt. % oxygen (O), about 0.0-0.003 wt. % phosphorus (P), about 0.0-0.0004 wt. % selenium (Se), about 0.0-0.1 wt. % silicon (Si), about 0.0-0.0003 wt. % silver (Ag), about 0.0-0.005 wt. % sulfur (S), about 2.5-3.5 wt. % tantalum (Ta), about 0.0-0.0001 wt. % tellurium (Te), about 4.0-5.0 wt. % titanium (Ti), about 0.0-0.001 wt. % thallium (Tl), about 2.5-3.5 wt. % tungsten (W), about 0.0-0.01 wt. % zirconium (Zr), with the balance comprising nickel (Ni).

According to an aspect of the invention, a nickel-based alloy comprises about 3.35-3.65 wt. % aluminum (Al), about 0.005-0.015 wt. % boron (B), about 0.0-0.00005 wt. % bismuth (Bi), about 0.065-0.095 wt. % carbon (C), about 11.5-12.5 wt. % chromium (Cr), about 11.5-12.5 wt. % cobalt (Co), about 0.0-0.15 wt. % iron (Fe), about 0.0-0.05 wt. % hafnium (Hf), about 0.0-0.0005 wt. % lead (Pb), about 0.0-0.01 wt. % magnesium (Mg), about 0.0-0.1 wt. % manganese (Mn), about 2.0-2.4 wt. % molybdenum (Mo), about 0.0-0.00015 wt. % nitrogen (N), about 0.0-0.1 wt. % niobium (Nb), about 0.0-0.0015 wt. % oxygen (O), about 0.0-0.002 wt. % phosphorus (P), about 0.0-0.0003 wt. % selenium (Se), about 0.0-0.06 wt. % silicon (Si), about 0.0-0.0002 wt. % silver (Ag), about 0.0-0.001 wt. % sulfur (S), about 2.8-3.2 wt. % tantalum (Ta), about 0.0-0.00005 wt. % tellurium (Te), about 4.55-4.85 wt. % titanium (Ti), about 0.0-0.0005 wt. % thallium (Tl), about 2.8-3.2 wt. % tungsten (W), about 0.0-0.004 wt. % zirconium (Zr), with the balance comprising nickel (Ni).

According to another aspect of the invention, the $Nv_{3B}$ of the alloy is less than 2.5. In embodiments, the $Nv_{3B}$ of the alloy is equal to or less than 2.4. In still another aspect, the density of the alloy is about 0.297-0.298 lb/in$^3$.

In still a further aspect of the invention, the alloy comprises about 3.5 wt. % aluminum (Al), about 0.012 wt. % boron (B), about 0.00005 wt. % bismuth (Bi), about 0.08 wt. % carbon (C), about 12.0 wt. % chromium (Cr), about 12.0 wt. % cobalt (Co), about 0.15 wt. % iron (Fe), about 0.05 wt. % hafnium (Hf), about 0.0005 wt. % lead (Pb), about 0.01 wt. % magnesium (Mg), about 0.1 wt. % manganese (Mn), about 2.2 wt. % molybdenum (Mo), about 0.0015 wt. % nitrogen (N), about 0.1 wt. % niobium (Nb), about 0.0015 wt. % oxygen (O), about 0.002 wt. % phosphorus (P), about 0.0003 wt. % selenium (Se), about 0.06 wt. % silicon (Si), about 0.0002 wt. % silver (Ag), about 0.001 wt. % sulfur (S), about 3.0 wt. % tantalum (Ta), about 0.00005 wt. % tellurium (Te), about 4.7 wt. % titanium (Ti), about 0.0005 wt. % thallium (Tl), about 3.0 wt. % tungsten (W), about 0.0075 wt. % zirconium (Zr), with the balance comprising nickel (Ni), and the $NV_{3B}$ of the alloy is 2.4.

According to yet another aspect of the invention, the alloy is cast in an equiaxed form to form a nickel-based alloy component, and wherein the component undergoes a solution heat treatment comprising the steps:

(a) heating the component to 2165 deg. F.+/−25 deg. F. at 25,000 psi+/−500 psi for 4 hours+/−15 minutes;
(b) solutioning at 2050 deg. F.+/−25 deg. F. and subsequently ramping to 2200 deg. F.+/−15 deg. F. at a maximum of 5 deg. F. per minute, holding this temperature for at least 2 hours;
(c) cooling the component, via gas quench, to 1500 deg. F. at more than 75 deg. F. per minute, and from 1500 deg. F. to below 1200 deg. F. at 10 deg. F. per minute or faster;
(d) heating to 2050 deg. F.+/−25 deg. F. for 2 hours;
(e) cooling the component to 1000 deg. F.;
(f) elevating the component to 1550 deg. F.+/−25 deg. F. and holding for at least 24 hours; and
(g) cooling the component to 1000 deg. F. or below.

According to still another aspect of the invention, the alloy comprises about 3.5 wt. % aluminum (Al), about 0.010 wt. % boron (B), about 0.00005 wt. % bismuth (Bi), about 0.08 wt. % carbon (C), about 12.0 wt. % chromium (Cr), about 12.0 wt. % cobalt (Co), about 0.15 wt. % iron (Fe), about 0.05 wt. % hafnium (Hf), about 0.0005 wt. % lead (Pb), about 0.01 wt. % magnesium (Mg), about 0.1 wt. % manganese (Mn), about 2.2 wt. % Molybdenum m(Mo), about 0.0015 wt. % nitrogen (N), about 0.1 wt. % niobium (Nb), about 0.0015 wt. % oxygen (O), about 0.002 wt. % phosphorus (P), about 0.0003 wt. % selenium (Se), about 0.06 wt. % silicon (Si), about 0.0002 wt. % silver (Ag), about 0.001 wt. % sulfur (S), about 3.0 wt. % tantalum (Ta), about 0.00005 wt. % tellurium (Te), about 4.7 wt. % titanium (Ti), about 0.0005 wt. % thallium (Tl), about 3.0 wt. % tungsten (W), about 0.0075 wt. % zirconium (Zr), with the balance comprising nickel (Ni), and the $NV_{3B}$ is 2.4.

In an embodiment, the alloy is a directionally solidified investment casting forming a nickel-based alloy component, and wherein the component is subjected to a heat treatment comprising the steps:

(a) heating the component to 2225 deg. F.+/−25 deg. F. at 20,000 psi+/−500 psi for 4 hours+/−15 minutes;
(b) solutioning at 2050 deg. F.+/−25 deg. F. and subsequently ramping to 2200 deg. F.+/−15 deg. F. at a maximum of 5 deg. F. per minute, and holding this temperature for at least 2 hours;
(c) cooling, via gas quench, to 1500 deg. F. at more than 75 deg. F. per minute, and cooling from 1500 deg. F. to below 1200 deg. F. at 10 deg. F. per minute or faster;
(d) heating the component to 2050 deg. F.+/−25 deg. F. for 2 hours;
(e) cooling to 1000 deg. F. at a rate equivalent to air cooling, or faster;
(f) elevating to 1550 deg. F.+/−25 deg. F. and holding for at least 24 hours; and
(g) cooling to 1000 deg. F. or below.

According to an aspect of the invention, the alloy measures increased creep resistance at the upper end of an operating spectrum of the component at temperatures greater than 1600 deg. F. In embodiment, the gas quench gas for cooling is Argon gas.

In another embodiment, the alloy is a single crystal alloy investment casting forming a nickel-based alloy component, and wherein the component is subjected to a heat treatment within 8 deg. of <001> direction, wherein the heat treatment comprises the steps of:

(a) heating the specimen to 2225 deg. F.+/−25 deg. F. at 20,000 psi+/−500 psi for 4 hours+/−15 minutes;
(b) solutioning at 2050 deg. F.+/−25 deg. F. and subsequently ramping to 2250 deg. F.+/−15 deg. F. at a maximum of 5 deg. F. per minute, and holding this temperature for at least 2 hours;
(c) cooling, via gas quench, to 1500 deg. F. at more than 75 deg. F. per minute and from 1500 deg. F. to below 1200 deg. F. at 10 deg. F. per minute or faster;
(d) heating to 2050 deg. F.+/−25 deg. F. for 2 hours;
(e) cooling to 1000 deg. F. at a rate equivalent to air cooling, or faster;
(f) elevating to 1550 deg. F.+/−25 deg. F. and holding for at least 24 hours;
(g) cooling to 1000 deg. F. or below.

According to one aspect, the alloy measures increased creep resistance at the upper end of an operating spectrum of the component at temperatures greater than 1600 deg. F.

According to another embodiment of the invention, a nickel-based alloy for a gas turbine component has about 3.35-3.65 wt. % aluminum (Al); about 0.005-0.015 wt. % boron (B); about 0.0-0.00005 wt. % bismuth (Bi); about 0.065-0.095 wt. % carbon (C); about 11.5-12.5 wt. % each of chromium (Cr) and cobalt (Co); about 0.0-0.15 wt. % iron (Fe); about 0.0-0.05 wt. % hafnium (Hf); about 0.0-0.0005 wt. % lead (Pb); about 0.0-0.01 wt. % magnesium (Mg); about 0.0-0.1 wt. % manganese (Mn); about 2.0-2.4 wt. % molybdenum (Mo); about 0.0-0.00015 wt. % nitrogen (N); about 0.0-0.1 wt. % niobium (Nb); about 0.0-0.0015 wt. % oxygen (O); about 0.0-0.002 wt. % phosphorus (P); about 0.0-0.0003 wt. % selenium (Se); about 0.0-0.06 wt. % silicon (Si); about 0.0-0.0002 wt. % silver (Ag); about 0.0-0.001 wt. % sulfur (S); about 2.8-3.2 wt. % tantalum (Ta); about 0.0-0.00005 wt. % tellurium (Te); about 4.55-4.85 wt. % titanium (Ti); about 0.0-0.0005 wt. % thallium (Tl); about 2.8-3.2 wt. % tungsten (W); about 0.0-0.004 wt. % zirconium (Zr); and the remaining balance is nickel (Ni). The alloy measures increased creep resistance at temperatures above 1600 in both directionally solidified and single crystal forms.

In one aspect, the density of the alloy is 0.297-0.298 $lb/in^3$. In another aspect, the $Nv_{3B}$ is equal to or less than 2.4. In still a further aspect, the yield strength of the alloy at 1200 deg. F. is greater than 110 ksi.

DETAILED DESCRIPTION

Embodiments of the invention are described with specificity herein to meet statutory requirements. However, the description is not intended to limit the scope of the patent. Rather, the invention may be embodied in other ways, and may include different steps of combinations of steps in conjunction with technologies currently employed or later developed.

Embodiments of a superalloy suitable for casting turbine blades or vanes, among other components, are described herein. As will be described in greater detail below, the superalloy may be cast in equiaxed, directionally solidified, and/or single crystal forms. The superalloy is further shown to have lower density as compared to other alloys, yet maintains desirable mechanical properties. It exhibits improved strength over other alloys utilizing common commercially available heat treatment cycles.

Definitions

Listed below are definitions of various terms used to describe the invention. The definitions apply to the terms are they are used throughout this specification and claims, unless otherwise limited in specific instances, either individually or as part of a larger group.

Unless defined otherwise, all technical and scientific terms used herein generally have the same meaning as commonly understood by one of ordinary skill in the art to which this invention belongs. Generally, the nomenclature used herein and the laboratory procedures are those well-known and commonly employed in the art.

As used herein, the articles "a" and "an" refer to one or to more than one (i.e. to at least one) of the grammatical object of the article. By way of example, "an element" means one element or more than one element. Furthermore, use of the term "including" as well as other forms, such as "include", "includes," and "included," is not limiting.

As used herein, the term "about" or "approximately" will be understood by persons of ordinary skill in the art and will vary to some extent on the context in which it is used. As used herein when referring to a measurable value such as an amount, a temporal duration, and the like, the term "about" is meant to encompass variations of ±0-20% from the specified value, as such variations are appropriate to perform the disclosed methods.

As used herein, the term "gas turbine engine" is an engine that provides mechanical output in the form of thrust for propelling a vehicle, or shaft power for driving an electrical generator. A typical gas turbine engine has a compressor, at least one combustor, and a turbine.

As used herein, the term "blade" refers to an airfoil attached to a disk or hub forming a single turbine section, which is connected to the compressor via a shaft. A single turbine section holds a plurality of blades. The blades may aid in the process of compressing the air flowing through a compressor, and/or may cause the disk (and therefore the shaft) to rotate via air passing over the surface of the blades.

As used herein, the term "vane" refers to a stationary airfoil that is often found in compressors and/or turbine sections and serves to redirect flow of air passing through the compressor or the turbine and towards a subsequent stage of rotating blades.

Blades and vanes are often cast from liquid metals, including alloys. The castings may be equiaxed (EQ), single crystal (SX), or directionally-solidified (DS). As is understood by those of skill in the art, in EQ castings, the grain boundaries of the solidified metal are free to form in any direction, and growth occurs substantially equally in all directions. In DS castings, the metal is cooled in a particular direction so as to form a set of grain boundaries that extend in a specific direction. In SX castings, the alloy is formed of a single crystal so as to avoid grain boundaries altogether.

Composition of the Invention and Examples

The invention is directed to superior nickel-based alloys which have lower density and improved mechanical properties. The specific chemistries of the composition may vary slightly depending on the casting technique to be utilized. Nevertheless, the alloy exhibits improved strength as compared to prior art alloys. According to an embodiment of the invention, a composition of the nickel-based alloy comprises the following elements as set forth in Table 1, below.

TABLE 1

| Alloy Composition | |
|---|---|
| Element | Weight Percent |
| Aluminum (Al) | 3.0-4.0 |
| Boron (B) | 0.005-0.015 |
| Bismuth (Bi) | 0.0-0.0001 |
| Carbon (C) | 0.03-0.08 |
| Chromium (Cr) | 10-15 |
| Cobalt (Co) | 10-15 |
| Iron (Fe) | 0.0-0.2 |
| Hafnium (Hf) | 0.0-0.1 |
| Lead (Pb) | 0.0-0.001 |
| Magnesium (Mg) | 0.0-0.02 |
| Manganese (Mn) | 0.0-0.2 |
| Molybdenum (Mo) | 1-3 |
| Nitrogen (N) | 0.0-0.002 |
| Nickel (Ni) | Balance |
| Niobium (Nb) | 0.0-0.2 |
| Oxygen (O) | 0.0-0.002 |
| Phosphorous (P) | 0.0-0.003 |
| Selenium (Se) | 0.0-0.0004 |
| Silicon (Si) | 0.0-0.1 |
| Silver (Ag) | 0.0-0.0003 |
| Sulfur (S) | 0.0-0.005 |
| Tantalum (Ta) | 2.5-3.5 |
| Tellerium (Te) | 0.0-0.0001 |
| Titanium (Ti) | 4.0-5.0 |
| Thallium (Tl) | 0.0-0.001 |
| Tungsten (W) | 2.5-3.5 |
| Zirconium (Z) | 0.0-0.01 |

Notably, the alloy of the invention has reduced tungsten content as compared to other nickel-based alloys. It was found that by reducing the amount of tungsten in the alloy and increasing the amount of molybdenum, that the castability of the alloy is increased. As described in more detail below, the density of the alloy is similar to that of other alloys, and was actually found to be slightly lower.

In one aspect of the invention, a composition of the nickel-based alloy comprises the following elements as set forth in Table 2, below.

TABLE 2

| Alloy Composition | |
|---|---|
| Element | Weight Percent |
| Aluminum (Al) | 3.35-3.65 |
| Boron (B) | 0.005-0.015 |
| Bismuth (Bi) | 0.0-0.00005 |
| Carbon (C) | 0.035-0.065 |
| Chromium (Cr) | 11.5-12.5 |
| Cobalt (Co) | 11.5-12.5 |
| Iron (Fe) | 0.0-0.15 |
| Hafnium (Hf) | 0.0-0.05 |
| Lead (Pb) | 0.0-0.0005 |
| Magnesium (Mg) | 0.0-0.01 |
| Manganese (Mn) | 0.0-0.1 |
| Molybdenum (Mo) | 2-2.4 |
| Nitrogen (N) | 0.0-0.00015 |
| Nickel (Ni) | Balance |
| Niobium (Nb) | 0.0-0.1 |
| Oxygen (O) | 0.0-0.0015 |
| Phosphorous (P) | 0.0-0.002 |
| Selenium (Se) | 0.0-0.0003 |
| Silicon (Si) | 0.0-0.06 |
| Silver (Ag) | 0.0-0.0002 |
| Sulfur (S) | 0.0-0.001 |
| Tantalum (Ta) | 2.8-3.2 |
| Tellerium (Te) | 0.0-0.00005 |
| Titanium (Ti) | 4.55-4.85 |
| Thallium (Tl) | 0.0-0.0005 |
| Tungsten (W) | 2.8-3.2 |
| Zirconium (Z) | 0.0-0.004 |

In another aspect of the invention, the composition of the nickel-based alloy comprises approximately 3.5 wt. % Al, approximately 0.010 wt. % B, approximately 0.00005 wt. % Bi, approximately 0.05 wt. % C, approximately 12.0 wt. % each of Cr and Co, approximately 0.15 wt. % Fe, approximately 0.05 wt. % Hf, approximately 0.0005 wt. % Pb, approximately 0.01 wt. % Mg, approximately 0.1 wt. % Mn, approximately 2.2 wt. % Mo, approximately 0.0015 wt. % N, approximately 0.1 wt. % Nb, approximately 0.0015 wt. % 0, approximately 0.002 wt. % P, approximately 0.0003 wt. % Se, approximately 0.06 wt. % Si, approximately 0.0002 wt. % Ag, approximately 0.001 wt. % S, approximately 3.0 wt. % Ta, approximately 0.00005 wt. % Te, approximately 4.7 wt. % Ti, approximately 0.0005 wt. % Tl, approximately 3.0 wt. % W, approximately 0.004 wt. % Zr, with the remaining balance comprising Ni.

It is important to understand how the alloy will perform under extreme operating conditions. Of particular interest is the alloy's structural stability. It is known that alloys experience solid phase reactions during service which may lead to the formation of embrittling phases. Specifically, nickel-based alloys may undergo formation of topologically close packed (TCP) phases. By determining the phasial stability ($Nv_{3B}$), also known as the average electron vacancy number, for the alloy, it may be possible to control the formation of the TCP phases. Phasial stability can be calculated according to the following equations as defined by the PWA N-35 method of nickel-based alloy electron vacancy TCP phase control factor calculation:

EQUATION 1

Conversion from weight percent to atomic percent:

$$\text{Atomic percent of element } i = P_i = \frac{\frac{W_i}{A_i}}{\sum i\left(\frac{Wi}{Ai}\right)} \times 100$$

-continued where:

$W_i$ = weight percent of element $i$ $A_i$ = atomic weight of element $i$

EQUATION 2

Calculation of the amount of each element present in the continuous matrix phase:

| Element | Atomic Amount $R_i$ in Matrix Phase |
|---|---|
| Cr | $R_{Cr} = 0.97\ P_{Cr} - 0375P_B - 1.75P_C$ |
| Ni | $R_{Ni} = P_{Ni} + 0.525P_B - 3(P_{Al} + 0.03P_{Cr} + P_{Ti} - 0.5P_C + 0.5P_V + P_{Ta} + P_{Cb} + P_{Hf})$ |
| Ti, Al, B, C, Ta, Hf | $R_i = 0$ |
| V | $R_V = 0.5P_V$ |
| W | $R_W = P_W - 0.167P_C \frac{P_{Mo}}{P_{Mo} + P_W}$ |
| Mo | $R_{Mo} = P_{Mo} - 0.75P_B - 0.167P_C \frac{P_{Mo}}{P_{Mo} + P_W}$ |

EQUATION 3

Calculation of $Nv_{3B}$ using atomic equations 1 and 2, above:

$$N_i i = \frac{R_i}{iR_t}, \text{ then } Nv_{3B} = \sum_i Ni(N_v)i$$

Where:

$i$ = each individual element $N_i i$ = atomic factor of each element $(N_v)i$ = electron vacancy number of each respective element The higher the value of $Nv_{3B}$, the less stable the alloy, and therefore, the greater the likelihood of TCP structure development. Prior studies have shown that it is desirable for the $Nv_{3B}$ to be less than about 2.5. For the composition described in Table 2, above, the $Nv_{3B}$ value is 2.4.

To enhance the mechanical properties of the alloy, a heat treatment may be applied. Several types of heat treatments are available, and the most appropriate heat treatment depends on the composition of the alloy and the desired properties and use of the end product. Well-known types of heat treatment include stress equalizing, stress relieving, annealing, solution annealing, and age hardening. Regardless of the specificities of the heat treatment, the goal is to remove stresses introduced into the alloys during cold work, restore ductility, reduce tensile properties, and strengthen the material.

Different heat treatments may be applied depending on the casting of the alloy, and particularly the component being cast. For example, the timing and/or temperatures of the heat treat cycles may vary. Here, heat treatments were applied to a nickel-based alloy equiaxed investment casting, nickel-based alloy directionally solidified investment casting, and a nickel-based single crystal alloy investment casting. In each of the castings, it was found that the alloys exhibited improved strength as compared to other alloys.

In one embodiment, a nickel-based alloy equiaxed investment casting has a composition comprising approximately 3.5 wt. % Al, approximately 0.012 wt. % B, approximately 0.00005 wt. % Bi, approximately 0.08 wt. % C, approximately 12.0 wt. % each of Cr and Co, approximately 0.15 wt. % Fe, approximately 0.05 wt. % Hf, approximately 0.0005 wt. % Pb, approximately 0.01 wt. % Mg, approximately 0.1 wt. % Mn, approximately 2.2 wt. % Mo, approximately 0.0015 wt. % N, approximately 0.1 wt. % Nb, approximately 0.0015 wt. % 0, approximately 0.002 wt. % P, approximately 0.0003 wt. % Se, approximately 0.06 wt. % Si, approximately 0.0002 wt. % Ag, approximately 0.001 wt. % S, approximately 3.0 wt. % Ta, approximately 0.00005 wt. % Te, approximately 4.7 wt. % Ti, approximately 0.0005 wt. % Tl, approximately 3.0 wt. % W, approximately 0.0075 wt. % Zr, with the remaining balance comprising Ni. The composition was cast into a test specimen and subjected to heat treatment by hot isostatic pressing (HIP) by heating the specimen to 2165 deg. F.+/−25 deg. F. at 25,000 psi+/−500 psi for 4 hours+/−15 minutes, followed by solutioning at 2050 deg. F.+/−25 deg. F. and subsequently ramping to 2200 deg. F.+/−15 deg. F. at a maximum of 5 deg. F. per minute, holding this temperature for at least 2 hours, followed by cooling to 1500 deg. F. at more than 75 deg. F. per minute. Cooling continues from 1500 deg. F. to below 1200 deg. F. at 10 deg. F. per minute or faster. The cooling preferably occurs in a gas environment comprising, for example, Argon, Helium, or Hydrogen. The cast is then subjected to a secondary solutioning treatment wherein the specimen is heating to 2050 deg. F.+/−25 deg. F. for 2 hours, followed by cooling to 1000 deg. F. at a rate equivalent to air cooling, or faster. Finally, the alloy is elevated to 1550 deg. F.+/−25 deg. F. and stabilized for at least 24 hours, before cooling to below 1000 deg. F., and eventually room temperature.

Mechanical properties of the equiaxed investment casting (EQ) are shown in Table 3 below. Table 3 shows ultimate tensile strength (UTS) data and yield strength (YS) data at room temperature, 800 deg. F., and 1200 deg. F. Creep-rupture data is also reported at 1800 deg. F. Table 3 further includes data for the GTD-111 alloy for comparison, taken from a Material Study completed by Wilson & Daleo Inc., and presented at the International Gas Turbine and Aero-engine Congress & Exhibition in Birmingham, UK on Jun. 10-13, 1996.

TABLE 3

Alloy Casting Mechanical Properties

| Alloy | Temp. (° F.) | UTS (ksi) | YS (ksi) @ 0.2% offset | Elongation in 4D (%) | Reduction in Area (%) | Stress (ksi) | Life (hrs) |
|---|---|---|---|---|---|---|---|
| EQ | Room (70) | 140 | 120 | 4.0 | 4.0 | | |
| EQ | 800 | 140 | 120 | 4.0 | 4.0 | | |

TABLE 3-continued

| Alloy Casting Mechanical Properties | | | | | | | |
|---|---|---|---|---|---|---|---|
| Alloy | Temp. (° F.) | UTS (ksi) | YS (ksi) @ 0.2% offset | Elongation in 4D (%) | Reduction in Area (%) | Stress (ksi) | Life (hrs) |
| EQ | 1200 | 155 | 110 | 6.0 | 8.0 | | |
| EQ | 1800 | | | 6.0 | 8.0 | 27 | 40 |
| GTD-111 | Room (70) | 142 | 120 | 9.0 | 16.7 | | |
| GTD-111 | 1200 | 163 | 107 | 13.5 | 16.6 | | |
| GTD-111 | 1600 | 124.3 | 101 | | | 48.5 | |
| GTD-111 | 1800 | | | 8.4 | 11.4 | 27.5 | 37.7 |

As can be seen in Table 3, at room temperature, the EQ alloy exhibits similar material properties to the GTD-111 alloy. However, at higher temperatures, the EQ alloy has a UTS within 5% of the GTD-111 alloy, and has a higher YS. At higher temperatures, specifically 1800 deg. F., the EQ alloy further exhibits improved life as compared to the GTD-111 alloy. Additionally, the EQ alloy shows reduced elongation than that of the GTD-111 alloy. For turbine blades and vanes especially, which tend to operate at elevated temperatures, reduced elongation equates to a stronger alloy.

In another embodiment, a nickel-based alloy directionally solidified investment casting has a composition comprising approximately 3.5 wt. % Al, approximately 0.010 wt. % B, approximately 0.00005 wt. % Bi, approximately 0.05 wt. % C, approximately 12.0 wt. % each of Cr and Co, approximately 0.15 wt. % Fe, approximately 0.05 wt. % Hf, approximately 0.0005 wt. % Pb, approximately 0.01 wt. % Mg, approximately 0.1 wt. % Mn, approximately 2.2 wt. % Mo, approximately 0.0015 wt. % N, approximately 0.1 wt. % Nb, approximately 0.0015 wt. % 0, approximately 0.002 wt. % P, approximately 0.0003 wt. % Se, approximately 0.06 wt. % Si, approximately 0.0002 wt. % Ag, approximately 0.001 wt. % S, approximately 3.0 wt. % Ta, approximately 0.00005 wt. % Te, approximately 4.7 wt. % Ti, approximately 0.0005 wt. % Tl, approximately 3.0 wt. % W, approximately 0.004 wt. % Zr, with the remaining balance comprising Ni. The composition was cast into a test specimen and subjected to heat treatment in the longitudinal direction by hot isostatic pressing (HIP) by heating the specimen to 2225 deg. F.+/−25 deg. F. at 20,000 psi+/−500 psi for 4 hours+/−15 minutes, followed by solutioning at 2050 deg. F.+/−25 deg. F. and subsequently ramping to 2200 deg. F.+/−15 deg. F. at a maximum of 5 deg. F. per minute, holding this temperature for at least 2 hours, followed by cooling to 1500 deg. F. at more than 75 deg. F. per minute. Cooling continues from 1500 deg. F. to below 1200 deg. F. at 10 deg. F. per minute or faster. The cooling preferably occurs in a gas environment comprising, for example, Argon, Helium, or Hydrogen. The cast is then subjected to a secondary solutioning treatment wherein the specimen is heating to 2050 deg. F.+/−25 deg. F. for 2 hours, followed by cooling to 1000 deg. F. at a rate equivalent to air cooling, or faster. Finally, the alloy is elevated to 1550 deg. F.+/−25 deg. F. and stabilized for at least 24 hours, before cooling to below 1000 deg. F., and eventually room temperature.

Mechanical properties of the directionally solidified investment casting (DS) are shown in Table 4 below. Table 4 shows ultimate tensile strength (UTS) data and yield strength (YS) data at room temperature, 800 deg. F., and 1200 deg. F. Creep-rupture data is also reported at 1800 deg. F. Table 4 further includes the data for the GTD-111 alloy for comparison.

TABLE 4

| Alloy Casting Mechanical Properties | | | | | | | |
|---|---|---|---|---|---|---|---|
| Alloy | Temp. (° F.) | UTS (ksi) | YS (ksi) @ 0.2% offset | Elongation in 4D (%) | Reduction in Area (%) | Stress (ksi) | Life (hrs) |
| DS | Room (70) | 150 | 130 | 4.0 | 6.0 | | |
| DS | 800 | 140 | 125 | 4.0 | 6.0 | | |
| DS | 1200 | 165 | 130 | 5.0 | 6.0 | | |
| DS | 1800 | | | 15 | 20 | 27 | 80 |
| GTD-111 | Room (70) | 142 | 120 | 9.0 | 16.7 | | |
| GTD-111 | 1200 | 163 | 107 | 13.5 | 16.6 | | |
| GTD-111 | 1800 | | | 8.4 | 11.4 | 27.5 | 37.7 |

Table 4 shows that, at room temperature, the DS alloy exhibits superior material properties as compared to the GTD-111 alloy. At higher temperatures, the DS alloy has a UTS within 2% of the GTD-111 alloy, yet exhibits an improved YS and reduced elongation and reduction in area. At 1800 deg. F., the DS alloy shows a much improved life as compared to the GTD-111 alloy, with greater than 50% improvement in creep over the GTD-111 alloy.

In still another embodiment, a nickel-based single crystal (SX) alloy investment casting has a composition comprising approximately 3.5 wt. % Al, approximately 0.010 wt. % B, approximately 0.00005 wt. % Bi, approximately 0.05 wt. % C, approximately 12.0 wt. % each of Cr and Co, approximately 0.15 wt. % Fe, approximately 0.05 wt. % Hf, approximately 0.0005 wt. % Pb, approximately 0.01 wt. % Mg, approximately 0.1 wt. % Mn, approximately 2.2 wt. % Mo, approximately 0.0015 wt. % N, approximately 0.1 wt. % Nb, approximately 0.0015 wt. % 0, approximately 0.002 wt. % P, approximately 0.0003 wt. % Se, approximately 0.06 wt. % Si, approximately 0.0002 wt. % Ag, approximately 0.001 wt. % S, approximately 3.0 wt. % Ta, approximately 0.00005 wt. % Te, approximately 4.7 wt. % Ti, approximately 0.0005 wt. % Tl, approximately 3.0 wt. % W, approximately 0.004 wt. % Zr, with the remaining balance comprising Ni. The composition was cast into a test specimen and subjected to heat treatment within 8 deg. of <001> direction by hot isostatic pressing (HIP) by heating the specimen to 2225 deg. F.+/−25 deg. F. at 20,000 psi+/−500 psi for 4 hours+/−15 minutes, followed by solutioning at 2050 deg. F.+/−25 deg. F. and subsequently ramping to 2250 deg. F.+/−15 deg. F. at a maximum of 5 deg. F. per minute, holding this temperature for at least 2 hours, followed by cooling to 1500 deg. F. at more than 75 deg. F. per minute. Cooling continues from 1500 deg. F. to below 1200 deg. F. at 10 deg. F. per minute or faster. The cooling preferably occurs in a gas environment comprising, for example, Argon, Helium, or Hydrogen. The cast is then subjected to a secondary solutioning treatment wherein the specimen is heated to 2050 deg. F.+/−25 deg. F. for 2 hours, followed by cooling to 1000 deg. F. at a rate equivalent to air cooling, or faster. Finally, the alloy is elevated to 1550 deg. F.+/−25 deg. F. and stabilized for at least 24 hours, before cooling to below 1000 deg. F., and eventually room temperature.

Material properties of the SX casting are shown in Table 5 below. Table 5 shows ultimate tensile strength (UTS) data and yield strength (YS) data at room temperature, 800 deg. F., and 1200 deg. F. Creep-rupture data is also reported at 1800 deg. F. Table 5 further includes data for the GTD-111 alloy for comparison.

TABLE 5

Alloy Casting Mechanical Properties

| Alloy | Temp. (° F.) | UTS (ksi) | YS (ksi) @ 0.2% offset | Elongation in 4D (%) | Reduction in Area (%) | Stress (ksi) | Life (hrs) |
|---|---|---|---|---|---|---|---|
| SX | Room (70) | 150 | 135 | 10 | 10 | | |
| SX | 800 | 145 | 130 | 10 | 10 | | |
| SX | 1200 | 150 | 120 | 10 | 10 | | |
| SX | 1800 | | | 10 | 10 | 27 | 85 |
| GTD-111 | Room (70) | 142 | 120 | 9.0 | 16.7 | | |
| GTD-111 | 1200 | 163 | 107 | 13.5 | 16.6 | | |
| GTD-111 | 1800 | | | 8.4 | 11.4 | 27.5 | 37.7 |

As shown in Table 5, the SX alloy also exhibits improved material properties to the GTD-111 alloy. At room temperature, the SX alloy shows higher tensile strength and yield strength. At higher temperatures, again, the SX alloy exhibits higher yield strength. At 1800 deg. F., the material properties of the SX-cast alloy are significantly improved over that of the GTD-111 alloy, again with a greater than 50% improvement in creep.

The density of the alloy further defines the desirable properties of the alloy. As is known by those of skill in the art, the longitudinal stress on an airfoil is proportional to the density squared. Accordingly, the lower the alloy density, the lower the longitudinal stresses exhibited by the airfoil. It was determined that the alloy having the composition levels described herein has a density of about 0.297-0.298 lb/in$^3$, which is less than the GTD-111 alloy, which as a density of 0.300 lb/in$^3$. Other alloys commonly used in gas turbine engines may have densities as high as 0.323 lb/in$^3$. The lower density of the alloy composition described herein is superiorly desirable as compared to other alloys, and results in lower rotational and centrifugal stresses on the cast component than what was previously achievable.

A method of making a cast and heat treated article of a nickel-based alloy is further disclosed. In an embodiment, the method includes casting the alloy in accordance with the composition levels descried herein, and subsequently subjecting the alloy to the heat treatment process described herein.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

The invention claimed is:

1. A nickel-based alloy for a gas turbine component, comprising:

3.0-4.0 wt. % aluminum (Al),
0.005-0.015 wt. % boron (B),
0.0-0.0001 wt. % bismuth (Bi),
0.03-0.05 wt. % carbon (C),
10.0-15.0 wt. % chromium (Cr),
10.0-15.0 wt. % cobalt (Co),
0.0-0.2 wt. % iron (Fe),
0.0-0.1 wt. % hafnium (Hf),
0.0-0.001 wt. % lead (Pb),
0.0-0.02 wt. % magnesium (Mg),
0.0-0.2 wt. % manganese (Mn),
1.0-3.0 wt. % molybdenum (Mo),
0.0-0.002 wt. % nitrogen (N),
0.1-0.2 wt. % niobium (Nb),
0.0-0.002 wt. % oxygen (O),
0.0-0.003 wt. % phosphorus (P),
0.0-0.0004 wt. % selenium (Se),
0.0-0.1 wt. % silicon (Si),
0.0-0.0003 wt. % silver (Ag),
0.0-0.005 wt. % sulfur (S),
2.5-3.5 wt. % tantalum (Ta),
0.0-0.0001 wt. % tellurium (Te),
4.0-5.0 wt. % titanium (Ti),
0.0003-0.001 wt. % thallium (Tl),
2.5-3.5 wt. % tungsten (W),
0.0-0.01 wt. % zirconium (Zr),
with the balance comprising nickel (Ni).

2. The alloy of claim 1, wherein the alloy comprises:

3.35-3.65 wt. % aluminum (Al),
0.005-0.015 wt. % boron (B),
0.0-0.00005 wt. % bismuth (Bi),
0.035-0.05 wt. % carbon (C), 11.5-12.5 wt. % chromium (Cr),
11.5-12.5 wt. % cobalt (Co),
0.0-0.15 wt. % iron (Fe),
0.0-0.05 wt. % hafnium (Hf),
0.0-0.0005 wt. % lead (Pb),
0.0-0.01 wt. % magnesium (Mg),
0.0-0.1 wt. % manganese (Mn),
2.0-2.4 wt. % molybdenum (Mo),
0.0-0.00015 wt. % nitrogen (N),
0.1-0.2 wt. % niobium (Nb),
0.0-0.0015 wt. % oxygen (O),
0.0-0.002 wt. % phosphorus (P),
0.0-0.0003 wt. % selenium (Se),
0.0-0.06 wt. % silicon (Si),
0.0-0.0002 wt. % silver (Ag),
0.0-0.001 wt. % sulfur (S),
2.8-3.2 wt. % tantalum (Ta),
0.0-0.00005 wt. % tellurium (Te),
4.55-4.85 wt. % titanium (Ti),
0.0003-0.0005 wt. % thallium (Tl),
2.8-3.2 wt. % tungsten (W),
0.0-0.004 wt. % zirconium (Zr),
with the balance comprising nickel (Ni).

3. The alloy of claim 2, wherein the Nv3B is less than 2.5.

4. The alloy of claim 3, wherein the Nv3B is equal to or less than 2.4.

5. The alloy of claim 3, wherein the density of the alloy is about 0.297-0.298 lb/in3.

6. The alloy of claim 2, wherein the alloy comprises:
3.5 wt. % aluminum (Al),
0.012 wt. % boron (B),
0.00005 wt. % bismuth (Bi),
0.05 wt. % carbon (C),
12.0 wt. % chromium (Cr),
12.0 wt. % cobalt (Co),
0.15 wt. % iron (Fe),
0.05 wt. % hafnium (Hf),
0.0005 wt. % lead (Pb),
0.01 wt. % magnesium (Mg),
0.1 wt. % manganese (Mn),
2.2 wt. % molybdenum (Mo),
0.0015 wt. % nitrogen (N),
0.1 wt. % niobium (Nb),
0.0015 wt. % oxygen (O),
0.002 wt. % phosphorus (P),
0.0003 wt. % selenium (Se),
0.06 wt. % silicon (Si),
0.0002 wt. % silver (Ag),
0.0001 wt. % sulfur (S),
3.0 wt. % tantalum (Ta),
0.00005 wt. % tellurium (Te),
4.7 wt. % titanium (Ti),
0.0005 wt. % thallium (Tl),
3.0 wt. % tungsten (W),
0.0075 wt. % zirconium (Zr),
with the balance comprising nickel (Ni).

7. The alloy of claim 4, wherein the Nv3B is 2.4.

8. The alloy of claim 2, wherein the alloy comprises:
3.5 wt. % aluminum (Al),
0.01 wt. % boron (B),
0.00005 wt. % bismuth (Bi),
0.05 wt. % carbon (C),
12.0 wt. % chromium (Cr),
12.0 wt. % cobalt (Co),
0.15 wt. % iron (Fe),
0.05 wt. % hafnium (Hf),
0.0005 wt. % lead (Pb),
0.01 wt. % magnesium (Mg),
0.1 wt. % manganese (Mn),
2.2 wt. % molybdenum (Mo),
0.0015 wt. % nitrogen (N),
0.1 wt. % niobium (Nb),
0.0015 wt. % oxygen (O),
0.002 wt. % phosphorus (P),
0.0003 wt. % selenium (Se),
0.06 wt. % silicon (Si),
0.0002 wt. % silver (Ag),
0.0001 wt. % sulfur (S),
3.0 wt. % tantalum (Ta),
0.00005 wt. % tellurium (Te),
4.7 wt. % titanium (Ti),
0.0005 wt. % thallium (Tl),
3.0 wt. % tungsten (W),
0.004 wt. % zirconium (Zr),
with the balance comprising nickel (Ni).

9. The alloy of claim 8, wherein the Nv3B is 2.4.

10. A nickel-based alloy for a gas turbine component, wherein the alloy comprises:
3.35-3.65 wt. % aluminum (Al);
0.005-0.015 wt. % boron (B);
0.0-0.00005 wt. % bismuth (Bi);
0.035-0.05 wt. % carbon (C);
11.5-12.5 wt. % each of chromium (Cr) and cobalt (Co);
0.0-0.15 wt. % iron (Fe);
0.0-0.05 wt. % hafnium (Hf);
0.0-0.0005 wt. % lead (Pb);
0.0-0.01 wt. % magnesium (Mg);
0.0-0.1 wt. % manganese (Mn);
2.0-2.4 wt. % molybdenum (Mo);
0.0-0.00015 wt. % nitrogen (N);
0.0-0.1 wt. % niobium (Nb);
0.0-0.0015 wt. % oxygen (O);
0.0-0.002 wt. % phosphorus (P);
0.0-0.0003 wt. % selenium (Se);
0.0-0.06 wt. % silicon (Si);
0.0-0.0002 wt. % silver (Ag);
0.0-0.001 wt. % sulfur (S);
2.8-3.2 wt. % tantalum (Ta);
0.0-0.00005 wt. % tellurium (Te);
4.55-4.85 wt. % titanium (Ti);
0.0003-0.0005 wt. % thallium (Tl);
2.8-3.2 wt. % tungsten (W);
0.0-0.004 wt. % zirconium (Zr); and
the remaining balance comprising nickel (Ni); and
wherein:
the alloy measures a 15% elongation, 4D after 80 hours at a temperature of 1800° F. in a directionally solidified form; and
the alloy measures a 10% elongation, 4D after 85 hours at a temperature of 1800° F. in a single crystal form.

11. The alloy of claim 10, wherein the density of the alloy is 0.297-0.298 lb/in3.

12. The alloy of claim 10, wherein the Nv3B is equal to or less than 2.4.

13. The alloy of claim 10, wherein the yield strength of the alloy at 1200° F. is greater than 110 ksi.

14. The alloy of claim 10, wherein the alloy measures a 20% reduction in area after 80 hours at a temperature of 1800° F. in the directionally solidified form.

15. The alloy of claim 14, wherein the alloy measures a 10% reduction in area after 85 hours at a temperature of 1800° F. in the single crystal form.

16. A method of forming a single crystal alloy investment casting component for a gas turbine engine, comprising:

(a) providing a nickel-based alloy for casting the component, the alloy comprising:
about 3.5 wt. % aluminum (Al),
about 0.01 wt. % boron (B),
about 0.00005 wt. % bismuth (Bi),
about 0.05 wt. % carbon (C),
about 12.0 wt. % chromium (Cr),
about 12.0 wt. % cobalt (Co),
about 0.15 wt. % iron (Fe),
about 0.05 wt. % hafnium (Hf),
about 0.0005 wt. % lead (Pb),
about 0.01 wt. % magnesium (Mg),
about 0.1 wt. % manganese (Mn),
about 2.2 wt. % molybdenum (Mo),
about 0.0015 wt. % nitrogen (N),
about 0.1 wt. % niobium (Nb),
about 0.0015 wt. % oxygen (O),
about 0.002 wt. % phosphorus (P),
about 0.0003 wt. % selenium (Se),
about 0.06 wt. % silicon (Si),
about 0.0002 wt. % silver (Ag),
about 0.001 wt. % sulfur (S),
about 3.0 wt. % tantalum (Ta),
about 0.00005 wt. % tellurium (Te),
about 4.7 wt. % titanium (Ti),
about 0.0005 wt. % thallium (Tl),
about 3.0 wt. % tungsten (W),
about 0.004 wt. % zirconium (Zr),
with the balance comprising nickel (Ni); and (b) subjecting the component to a heat treatment within 8 deg. of <001> direction, wherein the heat treatment comprises the steps of:
(1) heating the specimen to 2225° F.+/−25° F. at 20,000 psi+/−500 psi for 4 hours+/−15 minutes;
(2) solutioning at 2050° F.+/−25° F. and subsequently ramping to 2250° F.+/−15° F. at a maximum of 5° F. per minute, and holding this temperature for at least 2 hours;
(3) cooling, via gas quench, to 1500° F. at more than 75° F. per minute and from 1500° F. to below 1200° F. at 10° F. per minute or faster;
(4) heating to 2050° F.+/−25° F. for 2 hours;
(5) cooling to 1000° F. at a rate equivalent to air cooling, or faster;
(6) elevating to 1550° F.+/−25° F. and holding for at least 24 hours; and
(7) cooling to 1000° F. or below.

17. The method of claim 16, wherein the component measures a 10% elongation, 4D after 85 hours at temperatures greater than 1600° F.

18. The method of claim 16, wherein the gas quench gas for cooling is argon gas.

19. The method of claim 17, wherein the component measures a 10% reduction in area after 85 hours at temperatures greater than 1600° F.

20. The method of claim 16, wherein the component measures a 10% elongation, 4D and a 10% reduction in area after 85 hours at temperatures greater than 1600° F.

* * * * *